US006757503B2

(12) United States Patent
Kamimura

(10) Patent No.: US 6,757,503 B2
(45) Date of Patent: Jun. 29, 2004

(54) FIXING DEVICE IN AN IMAGE FORMING APPARATUS HAVING MULTIPLE HEATER LAMPS

(75) Inventor: Akira Kamimura, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/283,082

(22) Filed: Oct. 30, 2002

(65) Prior Publication Data

US 2004/0086292 A1 May 6, 2004

(51) Int. Cl.[7] ..... G03G 15/20
(52) U.S. Cl. ..... 399/69; 399/70
(58) Field of Search ..... 399/67, 69, 70, 399/328, 330, 334, 335

(56) References Cited

U.S. PATENT DOCUMENTS 5,978,618 A * 11/1999 Yamamoto et al. ..... 399/69
6,141,511 A * 10/2000 Nakayama ..... 399/69
6,353,718 B1 * 3/2002 Roxon et al. ..... 399/67

FOREIGN PATENT DOCUMENTS

JP 09-319250 A 12/1997
JP 2001-142543 A 5/2001

* cited by examiner

*Primary Examiner*—William J. Royer
(74) *Attorney, Agent, or Firm*—Foley & Lardner LLP

(57) ABSTRACT

A fixing device for an image forming apparatus includes a fixing heat roller having disposed therein a plurality of heater lamps and serving to press a paper sheet conveyed between the fixing heat roller and a pressure roller for heat fixing a toner image formed on the paper sheet. A control logic operates, in activating the heater lamps, to drive at least one of the heater lamps earlier than the other heater lamps and to drive the other heater lamps with a predetermined time delay. The at least one heater lamp of the plurality of heater lamps has a power consumption which is smaller than that of the other heater lamps.

7 Claims, 6 Drawing Sheets

FIXING DEVICE IN AN IMAGE FORMING APPARATUS HAVING MULTIPLE HEATER LAMPS

BACKGROUND OF THE INVENTION

1. Field of the Invention

The present invention relates to an image forming apparatus and, more specifically, to an image forming apparatus wherein a toner image formed on a paper sheet is thermally fixed by using a fixing heat roller having disposed therein a plurality of heater lamps.

2. Description of the Related Art

In an image forming apparatus, a fixing heat roller and a pressure roller are utilized to thermally fix a toner image formed on a paper sheet. A plurality of heater lamps such as halogen lamps are disposed within the fixing heat roller for heating the fixing heat roller and, in many cases, each heater lamp is on/off controlled independently with little consideration of the importance of the driving sequence of order of such lamps. If electrical power consumption of the heater lamps is large, electrical variation occurring during on/off controlling is increased and, in some cases, there is a fear that a flicker occurs in a common electrical power system which exceeds a permissible limit.

In the above conventional image forming apparatus, if the electrical power consumption of the heater lamps is large, the electrical variation due to rush current flowing during on/off controlling of the heater lamps is increased, and specifically since the heater lamps are cold when the fixing heat roller is just started and therefore, the resistance thereof is low, there is a fear that a large flicker may occur. To solve such problems, Japanese Patent Application KOKAI Publication No. 2001-142543 proposed that a plurality of heater lamps should be connected in series during the start-up thereof. Since the plural heater lamps are started simultaneously, however, this method cannot sufficiently suppress the flicker.

SUMMARY OF THE INVENTION

The present invention has been made in order to solve the above problems, and its object is to provide an image forming apparatus in which a large flicker will not occur when activating heater lamps even if such a fixing heat roller is used as having incorporated therein a heater lamp whose power consumption is large.

To solve this problem, the fixing device according to the present invention comprises a fixing heat roller having disposed therein a plurality of heater lamps and operable to press a paper sheet conveyed between said fixing heat roller and a pressure roller for heat fixing a toner image formed on the paper sheet, and a control operable in activating the heater lamps to drive at least one of said heater lamps earlier than the other heater lamps and to drive said other heater lamps with a predetermined time delay.

By so constructing, in starting the fixing device to heat the fixing heat roller to a predetermined temperature by means of a plurality of heater lamps disposed within the fixing heat roller of the image fixing mechanism, the control can drive, for example, only one heater lamp earlier than the other heater lamps without driving a plurality of or all of the heater lamps, so that the rush current in the driving can be reduced, and since the remaining heater lamps are heated by the earlier driven heater lamp when they are driven with a predetermined time delay, the rush current by such remaining heater lamp can be also reduced. Thus, the fear of a large flicker occurring in the common power system of the image forming apparatus can be eliminated.

In the above fixing device of the invention, said at least one heater lamp of said plurality of heater lamps has a power consumption which is smaller than that of the other heater lamps, and said control is operable in activating the heater lamps to drive firstly said at least one heater lamp whose power consumption is smaller than that of said other heater lamps and to drive said other heater lamps with a predetermined time delay.

By so constructing, the fixing device has the same advantage as that of the image forming apparatus stated above, and since the firstly driven heater lamp has a power consumption smaller than that of the remaining heater lamps, the rush current and hence the flicker in firstly driving the heater lamp can be minimal.

Additionally, in the fixing device according to the present invention, said plurality of heater lamps includes a first heater lamp, and a second heater lamp of which power consumption is larger than that of said first heater lamp, and said control includes a drive command generator for generating first and second pulsed drive commands whose cycles, pulse widths and rise timings are the same and which have first and second voltage levels, respectively, a delay circuit providing said second drive command with a predetermined time delay thereby to generate a third drive command having the second voltage level, a roller temperature detector for detecting the temperature on the surface of said fixing heat roller, a bias supply circuit for supplying first and second bias voltages corresponding to the temperatures detected by said roller temperature detector, a first comparator for comparing the first voltage level of said first drive command and said first bias voltage, a first lamp drive for driving said first heater lamp if said first comparator determines that said first voltage level is higher than said first bias voltage, a second comparator for comparing the second voltage level of said third drive command and said second bias voltage, a second lamp drive for driving said second heater lamp if said second comparator determines that said second voltage level is higher than said second bias voltage.

By so constructing, the control has only to generate the first and second drive commands, and the delay circuit, the first and second comparators and the first and second lamp drives operate in conjunction with each other to cause the first heater lamp whose power consumption is small to be driven firstly and the second heater lamp whose power consumption is larger than that of the first heater lamp to be driven with a predetermined time delay. Because the times at which the first and second heater lamps are driven are thus staggered, a large rush current will not flow at a time. Additionally, since the second heater lamp is heated by the earlier driven first heater lamp when the second heater lamp, whose power consumption is large, is driven, a large rush current due to driving the second heater lamp will not occur. Thus, the fear of a large flicker occurring in the common power system of the image forming apparatus can be eliminated. As mentioned above, because the delay circuit and the first and second comparators are operable to automatically adjust the time of drive command generation in driving of the fixing device and also to automatically control the heater lamp temperature during operation, controlling by the drive command generator can be simplified.

Furthermore, the image forming apparatus according to the present invention comprises a photosensitive body on which a latent image is formed, a developing device for visualizing the latent image on said photosensitive body, a transfer device for transferring the visualized image to a paper sheet, and a fixing device for fixing the transferred image, said fixing device including a pressure roller, a fixing heat roller having disposed therein a plurality of heater lamps and operable in conjunction with said pressure roller to press the paper sheet conveyed thereto for heat fixing a toner image formed on the paper sheet and a control operable in activating the heater lamps to drive at least one of said heater lamps earlier than the other heater lamps and drive said other lamps with a predetermined time delay.

In the above image forming apparatus, said at least one heater lamp of the plurality of heater lamps has a power consumption which is smaller than that of the other heater lamps, and the control is operable in activating the heater lamps to drive firstly said at least one heater lamp and to drive said other lamps with a predetermined time delay.

The present invention further provides a method of heating a fixing heat roller which has disposed therein a plurality of heater lamps and operable to press a paper sheet conveyed between said fixing heat roller and a pressure roller for heat fixing a toner image formed on the paper sheet, comprising the steps of driving at least one of said heater lamps earlier than the other lamps in activating the heater lamps, and driving said other lamps with a predetermined time delay. In this method, the heater lamp which is driven earlier than the other heater lamps has a power consumption which is smaller than that of said other heater lamps.

Additionally, the present invention still further provides a fixing heat roller of a fixing device, which has disposed therein at least two heater lamps and is operable to press a paper sheet conveyed between said fixing heat roller and a pressure roller for heat fixing a toner image formed on the paper sheet, wherein said at least two heater lamps includes, a first heater lamp whose power consumption is smaller than that of the other heater lamps and which is firstly started to be driven in activating the heater lamps, and a second heater lamp whose power consumption is larger than that of said first heater lamp and which is started to be driven with a predetermined time delay after the start of driving said first heater lamp.

DESCRIPTION OF THE PREFERRED EMBODIMENTS

Now, the embodiment of the present invention will be explained hereinafter with reference to the accompanying drawings.

Figure 1:
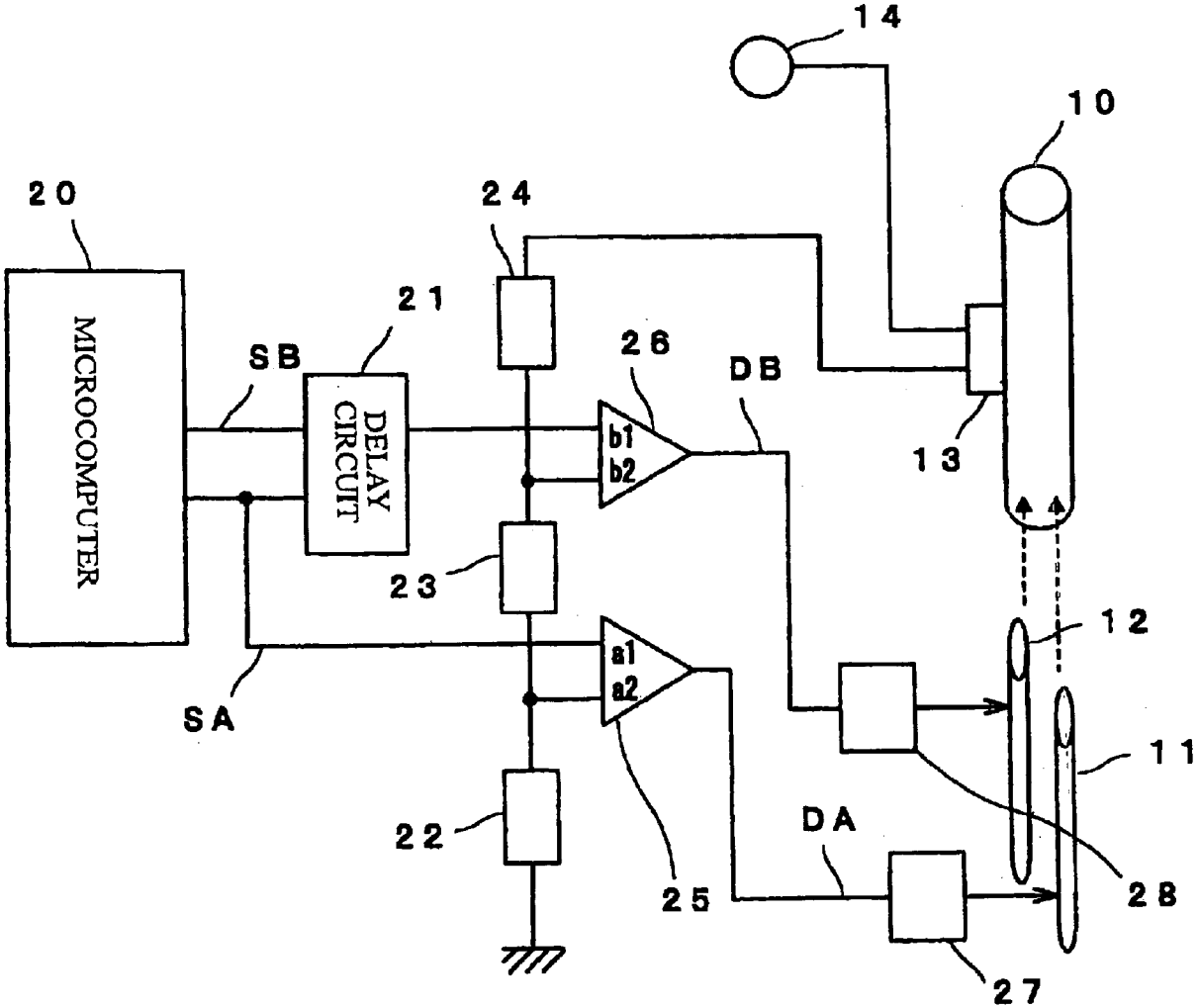
FIG. 1 is a block diagram showing an embodiment of the image forming apparatus of the present invention.
Figure 6:
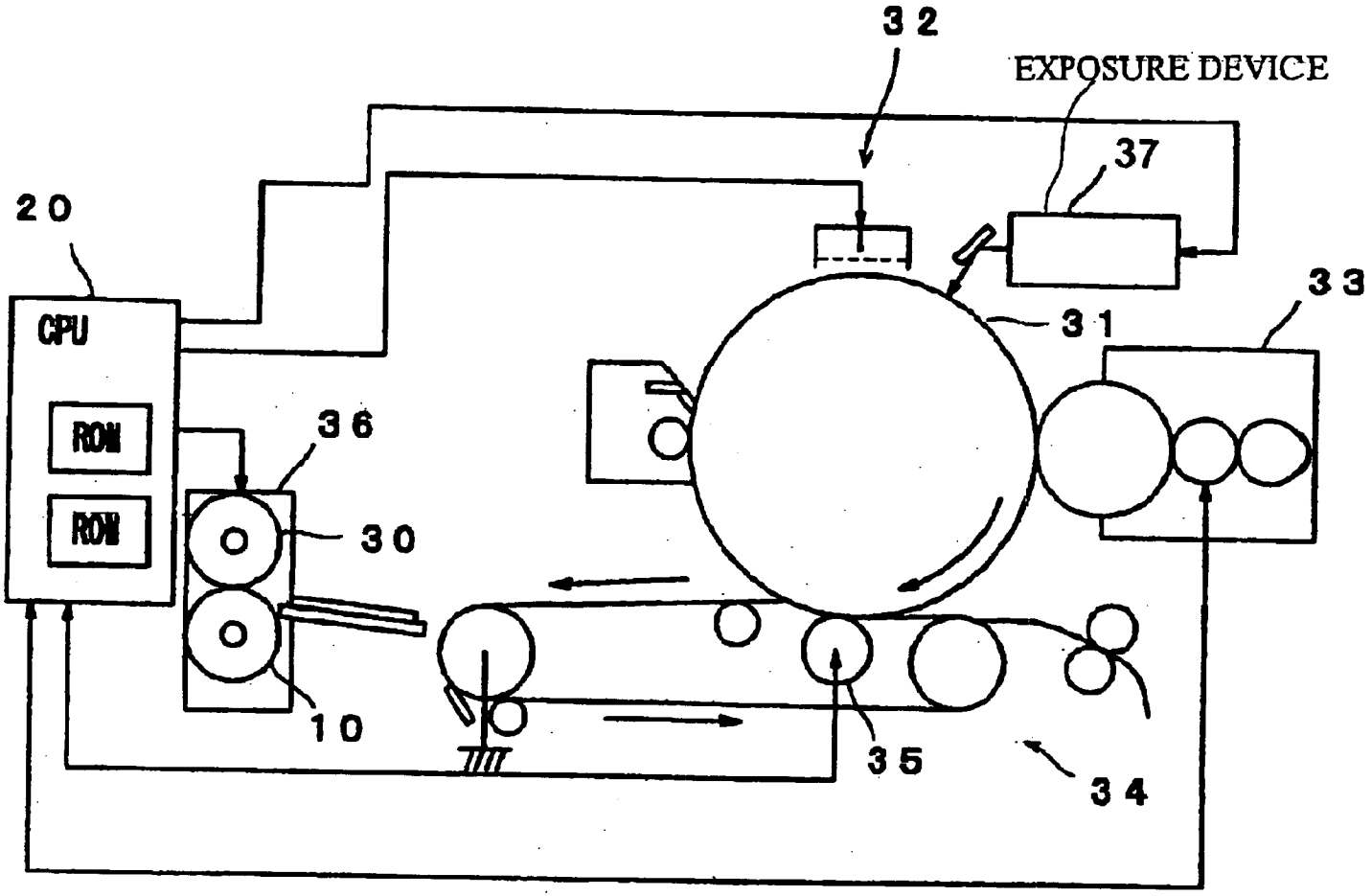
FIG. 6 is a schematic structural diagram showing the image forming apparatus of the present invention.

In the image forming apparatus of FIG. 1, a toner image formed on a paper sheet is thermally fixed by a fixing heat roller 10 and a pressure roller 30 (see FIG. 6).

Referring to FIG. 1, the fixing heat roller 10 has disposed therein first and second heater lamps 11, 12 (e.g., halogen lamps) for heating the fixing heat roller 10. Electrical power consumption of the second heater lamp 12 is larger than that of the first heater lamp 11, so that rush current flowing in the second heater lamp 12 when activating the lamp is greater than that flowing in the first heater lamp 11. There is provided a thermistor 13 as the roller temperature detector in opposing relation to the outer surface of the fixing heat roller 10 for detecting the temperature on the outer surface of the fixing heat roller 10. The thermister 13, one terminal of which is connected to a constant voltage power source 14, is operable such that it offers a higher resistance when the temperature on the outer surface of the fixing heat roller 10 is low, so that current then flowing from the constant voltage power source 14 becomes more difficult to flow, and it offers a lower resistance when the temperature on the outer surface of the fixing heat roller 10 is higher, so that current from the constant voltage power source 14 becomes easier to flow.

Figures 2A, 2B:
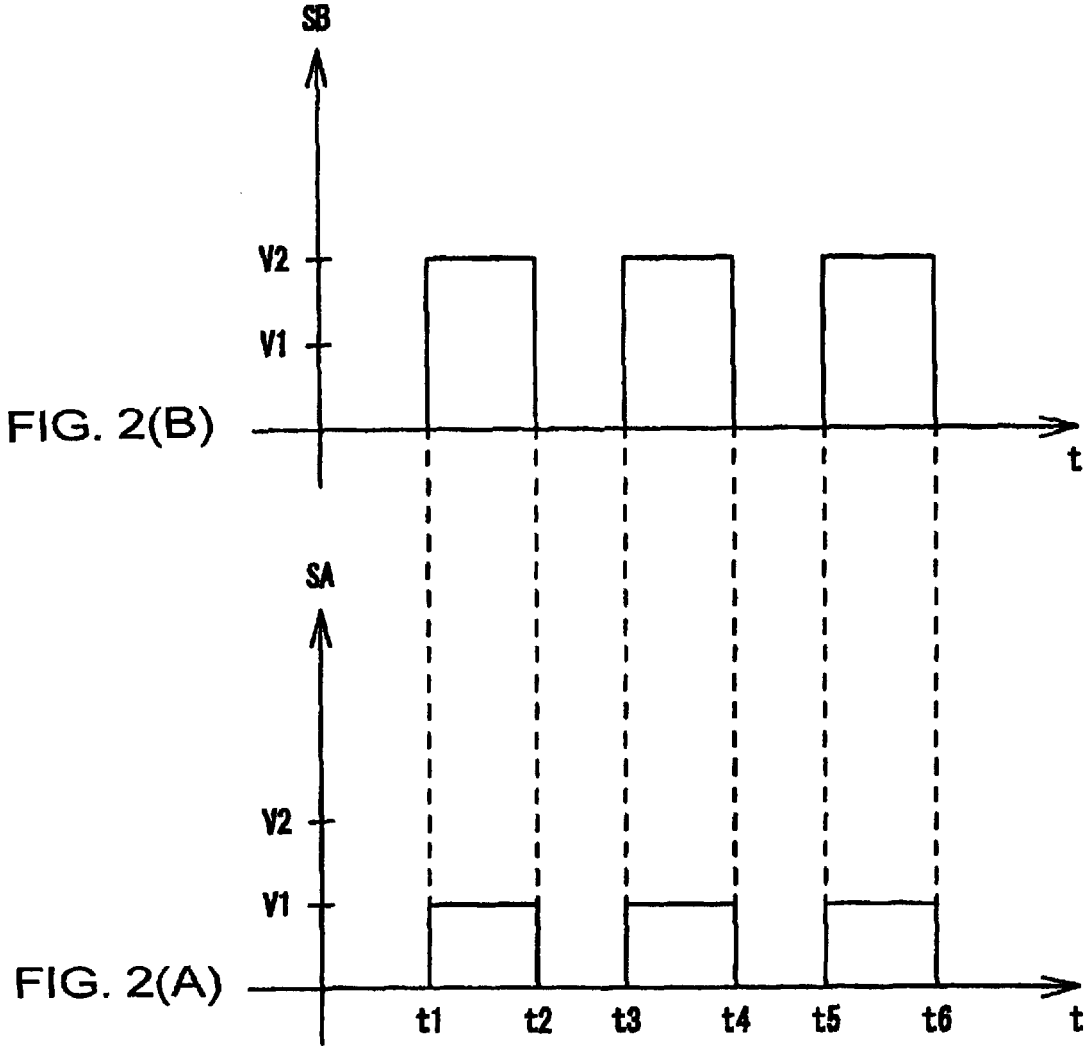
FIG. 2(A) and FIG. 2(B) are time charts showing first and second drive commands generated by a microcomputer of the image forming apparatus of FIG. 1.
Figures 3A, 3B:
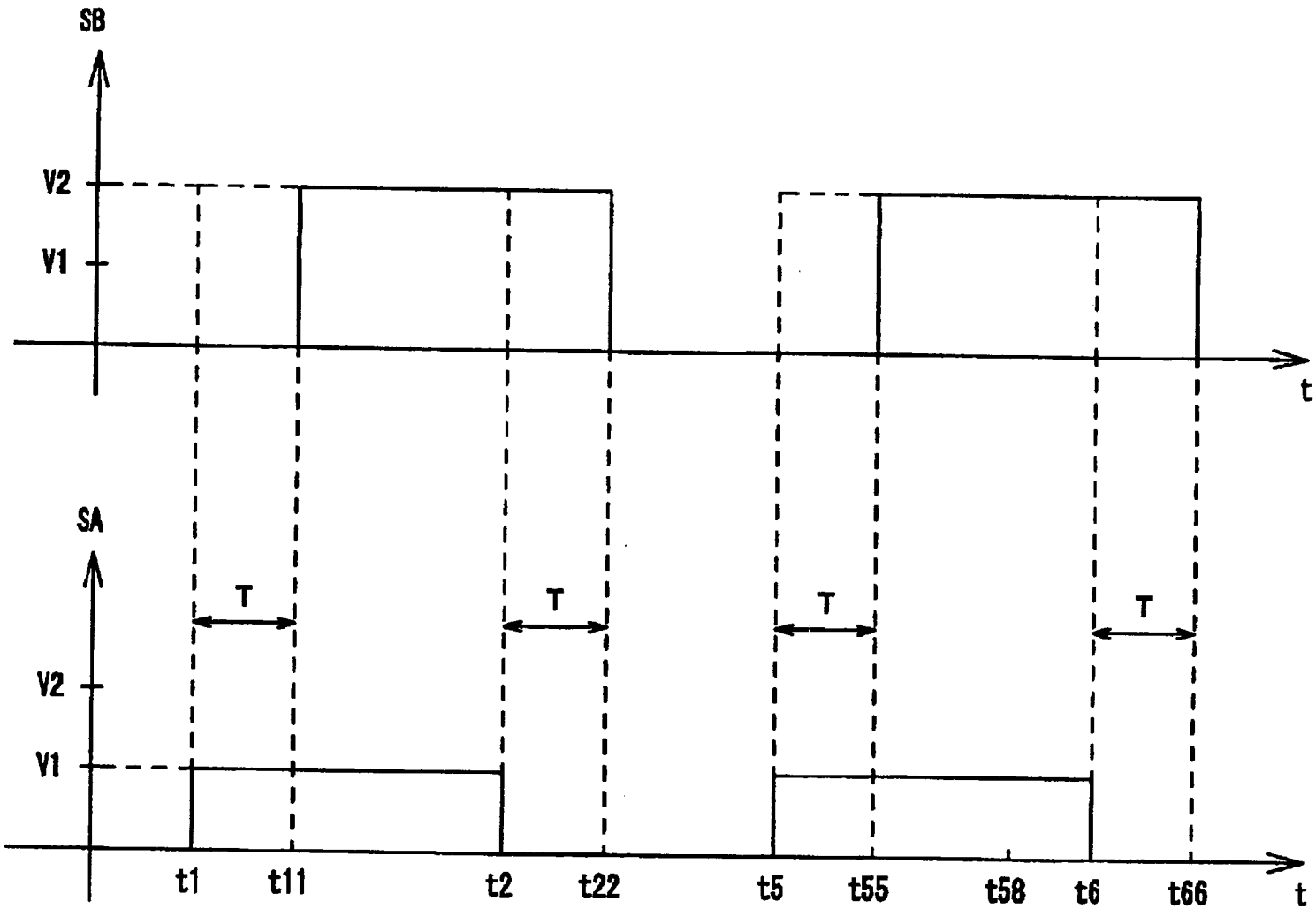
FIG. 3(A) and FIG. 3(B) are time charts showing drive commands at the first input terminals of the first and second comparators, respectively.
Figure 5:
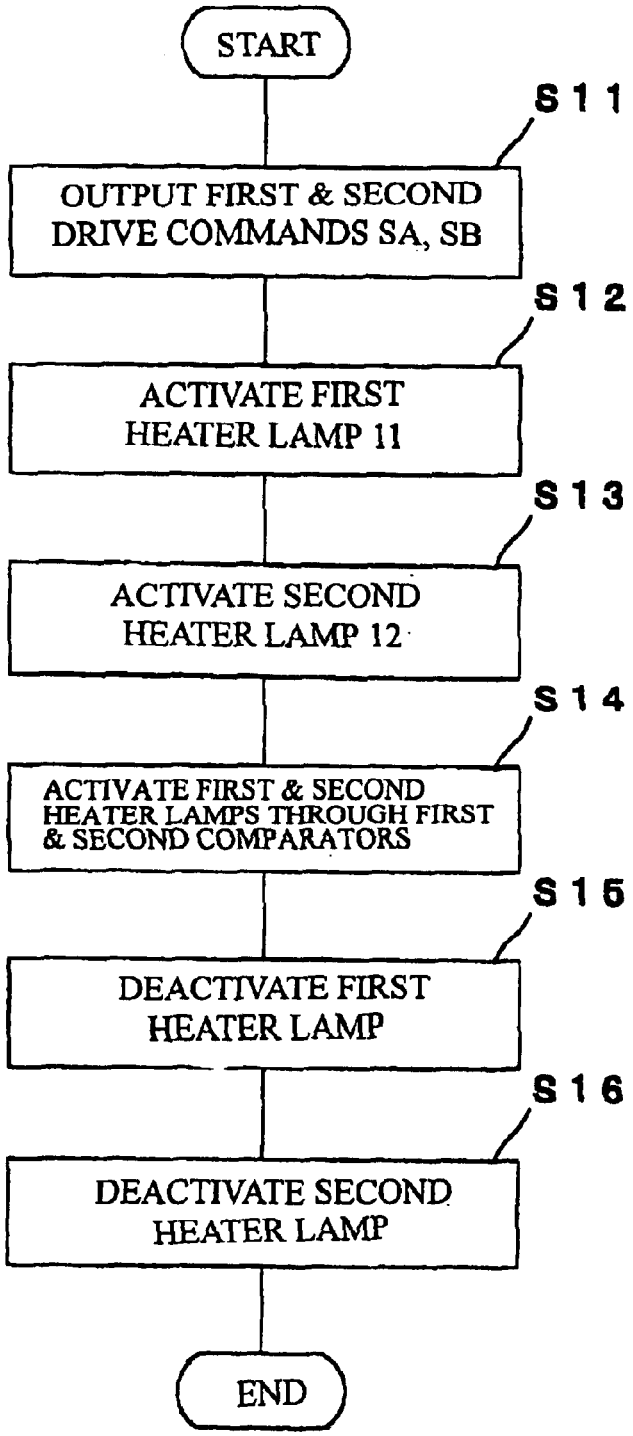
FIG. 5 is a flowchart showing a control action in heating a fixing heat roller of the image forming apparatus of FIG. 1.

A control circuit for activating the above first and second heater lamps 11, 12 and controlling the heating by the first and second heater lamps 11, 12 in an optimum manner depending on the temperature detected by the thermistor 13 includes a microcomputer 20 which serves as the drive command generator, a delay circuit 21, resistors 22, 23, 24, first and second comparators 25, 26 and first and second lamp drive circuits 27, 28 as the lamp drive. The microcomputer 20 is operable according to a control program to generate first and second drive commands SA, SB with voltage levels V1, V2, respectively, at the same timing as shown in FIG. 2 (step S11 in FIG. 5) to activate the first and second heater lamps 11, 12, wherein V1<V2. The first drive command SA thus generated is applied to a first input terminal a1 of the first comparator 25 as shown by the time t1–t2 of FIG. 3. However, the second drive command SB is received by the delay circuit 21 during the time t1–t2, and then applied with a predetermined time delay T to a first input terminal b1 of the second comparator 26 during the time t11–t22 (FIG. 3).

Figures 4A, 4B:
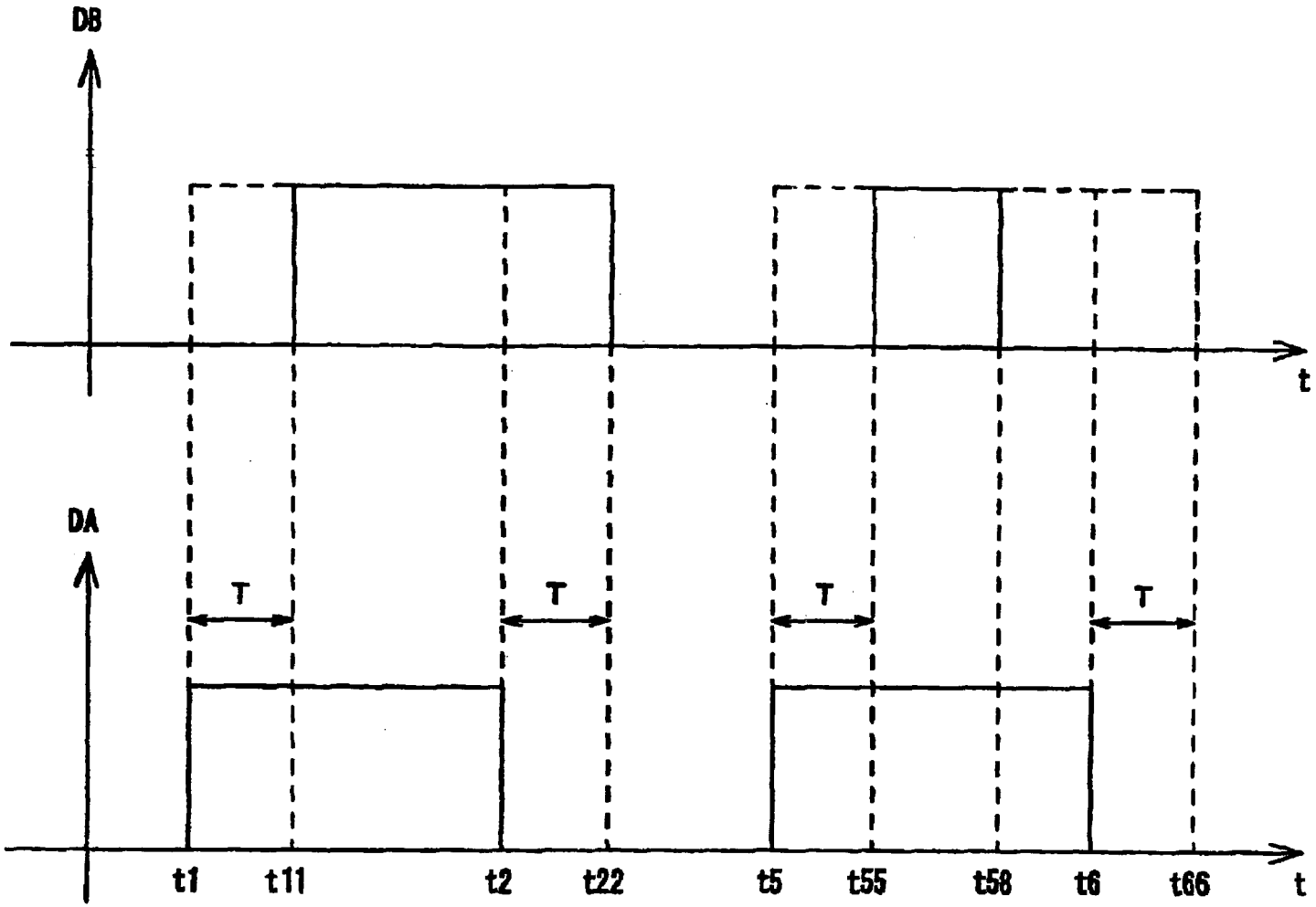
FIG. 4(A) and FIG. 4(B) are time charts showing outputs from the first and second comparators, respectively.

During the starting (e.g. the time t1–t22 in FIG. 3) when the temperature on the outer surface of the fixing heat roller 10 is low and, therefore, the thermister 13 offers a high resistance, the current flowing from the constant voltage power source 14 to the resistors 22, 23, 24 through the thermister 13 is small, so that the voltage applied to second input terminals a2, b2 of the comparators 25, 26 through the resistors 22, 23, 24 is low. As compared with the voltages applied to the second input terminal a2, b2 of the comparators 25, 26, the voltages of the first and second drive commands SA, SB applied to the first input terminals a1, b1 of the comparators 25, 26 is higher. Then, the first and second comparators 25, 26 generate drive outputs DA, DB to the first and second lamp drive circuits 27, 28, as shown in FIG. 4. Thus, the first lamp drive circuit 27 turns on the first heater lamp 11 at the time t1 (S12), while the second lamp drive circuit 28 turns on the second heater lamp 12 at the time t11 (S13) with a delay of time T as counted from the time t1 by the delay circuit 21.

Because the times of activating the first heater lamp 11 with a small rush current and the second heater lamp 12 with a large rush current are staggered by the time T, variation of supply power during the start-up operation can be reduced and the maximum value of flicker can be reduced, accordingly. Furthermore, when activating the second heater lamp 12 (time t11) which tends to cause a larger rush current and hence the above problems, the second heater lamp 12 itself is heated by the first heater lamp 11 to some extent during the time T and, therefore, the rush current can be suppressed and the flicker can be reduced. Such reduction of the maximum value of flicker is advantageous not only technically, but in compliance to legal regulations inherent in the technology to which this invention pertains.

The following will then explain controlling during normal operation of the fixing heat roller 10 after the first and second heater lamps 11, 12 have been activated. During normal operation of the fixing heat roller 10, on/off control of the first and second heater lamps 11, 12 is performed by the first and second comparators 25, 26 for the first and second drive commands SA, SB, respectively (S14). That is, since the voltages applied to the second input terminals a2, b2 of the first and second comparators 25, 26 through the thermister 13 are lower than the voltages V1, V2 of the first and second drive commands applied to the first input terminal a1, b1 as far as the temperature on the outer surface of the fixing heat roller 10 is below a threshold value, the first and second comparators 25, 26 continue to supply the drive outputs DA, DB to the first and second lamp drive circuits 27, 28 as shown by the time t1–t22 in FIG. 4, so that the first and second heater lamps 11, 12 are kept in "on" state and, therefore, the fixing heat roller 10 continues to be heated.

As the first and second lamp drive circuits 27, 28 continue to drive the first and second heater lamp 11, 12 for heating, the resistance of the thermister 13 is decreased gradually with an increase of the temperature on the outer surface of the fixing heat roller 10 and the voltages applied to the second input terminals a2, b2 of the first and second comparators 25, 26 are increased, accordingly. When the temperature on the outer surface of the fixing heat roller 10 exceeds a first threshold value (e.g. at the time t58 in FIGS. 3(A) and (B)), the voltage applied to the second input terminal b2 of the second comparator 26 becomes higher than the voltage V2 applied to the first input terminal b1 and the second comparator 26 comparing such voltages is operated to stop generation of the drive output DB at the time t58 without proceeding to the time t66, so that the second lamp drive circuit 28 causes the second heater lamp 12 to stop its heating operation.

In the above case, because the voltage applied to the second input terminal a2 of the first comparator 25 is lower than the voltage V1 applied to the first input terminal a1, the first comparator 25 continues to generate the drive output DA. When the temperature on the outer surface of the fixing heat roller 10 is decreased to or below the first threshold value after the second heater lamp 12 is deactivated to stop heating, the second comparator 26 generates the drive output DB again and the second lamp drive circuit 28 causes the second heater lamp 12 to be activated again for heating. If the temperature on the outer surface of the fixing heat roller 10 is increased for any reason beyond a second threshold value while the second lamp drive circuit 28 keeps the second heater lamp 12 to stop its heating operation because of the temperature on the outer surface of the fixing heat roller 10 exceeding the first threshold value, the voltage applied to the second input terminal a2 of the first comparator 25 becomes higher than the voltage V1 applied to the first input terminal a1.

If the voltage at the second input terminal a2 of the first comparator 25 thus becomes higher than the first voltage V1 applied to the first input terminal a1, the first comparator 25 comparing such voltages is operated to stop generation of the drive output DA and the first lamp drive circuit 27 causes the first heater lamp 11 to stop its heating operation, accordingly. With the first and second heater lamps 11, 12 thus deactivated, the temperature on the outer surface of the fixing heat roller 10 is decreased gradually and the first and second heater lamps 11, 12 are activated again usually in this order for heating. Although, in the above embodiment described by way of an example, firstly heating by the second heater lamp 12 is stopped when the temperature on the outer surface of the fixing heat roller 10 has exceeded a threshold value, it may be so arranged that firstly heating by the first heater lamp 11 is stopped. Such setting can be made possible by changing the resistances of the resistors 22, 23, 24 or the voltage levels V1, V2 of the first and second drive commands SA, SB.

Then the following will explain the operation of the microcomputer 20 when terminating the heating operation of the fixing heat roller 10 by the first and second heater lamps 11, 12. It is assumed that the first and second heater lamps 11, 12 are being driven by the first and second lamp drive circuits 27, 28, respectively, when the heating is to be terminated. When the microcomputer 20 stops generation of the first and second drive commands SA, SB to stop driving of the heater lamps 11, 12, the voltage applied to the first input terminal a1 of the first comparator 25 becomes lower than the voltage at the second input terminal a2, so that generation of the drive output DA is stopped and the first lamp drive circuit 27 stops driving the first heater lamp 11 (S15). On the other hand, stop of the second drive command SB is not then transmitted to the second comparator 26 due to the operation of the delay circuit 21 and the voltage at the first input terminal b1 is maintained at the second voltage V2, so that the second lamp drive circuit 28 continues to drive the second heater lamp 12.

With an elapse of a predetermined time T after the stop of the first and second drive commands SA, SB, however, stop of the second drive command SB is transmitted from the delay circuit 21 to the second comparator 26 and the voltage at the first input terminal b1 of the second comparator 26 becomes lower than the voltage at the second terminal b2, so that generation of the drive output DB is stopped and the second lamp drive circuit 28 stops driving of the second heater lamp 12 (S16). Though the above description has been made on the assumption that, when terminating the heating operation, the first and second heater lamps 11, 12 are being driven by the first and second lamp drive circuits 27, 28, if either one of first and second heater lamps 11, 12 is already deactivated to stop its heating, it is needless to say that the heating operation is terminated with the deactivated heater lamp maintained as it is. If it is desired to stop driving of the second heater lamp 12 earlier than the first heater lamp 11, e.g. earlier by the time T, it may be so arranged that the microcomputer 20 is operable to stop generation of the second drive command SB earlier than the first drive command SA by the time corresponding to twice as long as the time T.

As mentioned earlier, on/off operation of the heater lamps while the temperature of the fixing heat roller is maintained at a predetermined level after heating by the heater lamps has been once completed will not invite a fear of a large flicker, but driving a heater lamp, whose power consumption is large, while the heater lamp and the fixing heat roller are not heated, there is a fear that a flicker occurs, thereby causing electrical variation to exceed a permissible limit value of the common electrical power system. In the above-described embodiment, a plurality of heater lamps (or two heater lamps) is driven with a time delay so as to prevent flowing of a large current at a time. To be more specific, the current flowing during the start-up can be small by firstly activating the heater lamp whose power consumption is small earlier than the other heater lamp and, additionally, when activating the other heater lamp whose power consumption is large, the fixing heat roller is already heated to some extent by the firstly activated heater lamp whose power consumption is small, the current flowing when the heater lamp whose power consumption is large is activated can be reduced. Thus, the fear of a large flicker can be eliminated. This is applicable to a case wherein the plural heater lamps whose power consumption is the same, and in such a case any one of the heater lamps may be selected for the first activation. Additionally, because the delay circuit and the first and second comparators provide automatic time adjustment of the drive commands during start-up operation and also automatic temperature controlling of the heater lamps during normal heating operation, controlling by the microcomputer can be simplified.

FIG, 6 is a schematic structural diagram showing an embodiment of the image forming apparatus of the invention. In the drawing, the image forming apparatus includes a photosensitive body 31, a charging device 32 disposed adjacent to the photosensitive body 31 for charging the photosensitive body 31, an exposure device 37 for forming a latent image on the photosensitive body 31, a developing device 33 for visualizing the latent image, a conveying device 34 for conveying a paper sheet and a transfer device 35 for transferring the visualized image to the paper sheet conveyed thereto, and there is provided at the downstream end of the conveying device 34 a fixing device 36 having the aforementioned fixing heat roller 10 and pressure roller 30.

In the embodiment of the present invention constructed as described above, in activating the fixing heat roller by a plurality of heater lamps disposed therein for heating the fixing heat roller to a predetermined temperature, the control is operated to activate the heater lamps with such a time interval so that one of the heater lamps is activated earlier than the other heater lamps, without activating a plurality of or all of the heater lamps simultaneously, with the result that rush current flowing during such activation of the heater lamps can be reduced. When the remaining heater lamps are activated with a predetermined time delay, these lamps are already heated by the previously activated heater lamp and, therefore, the rush current caused by activation of these remaining heater lamps can be small. In start-up operation of the fixing heat roller, therefore, the fear of a large flicker occurring in the common power system of the image forming apparatus can be eliminated.

What is claimed:

1. A fixing device comprising:

a fixing heat roller having disposed therein a plurality of heater lamps and serving to press a paper sheet conveyed between said fixing heat roller and a pressure roller for heat fixing a toner image formed on the paper sheet; and a control operating, in activating the heater lamps, to drive at least one of said heater lamps earlier than the other heater lamps and to drive said other heater lamps with a predetermined time delay, wherein said at least one heater lamp of said plurality of heater lamps has a power consumption which is smaller than that of the other heater lamps.

2. A fixing device according to claim 1, wherein said control operates, in activating the heater lamps, to drive firstly said at least one heater lamp whose power consumption is smaller than that of said other heater lamps and to drive said other heater lamps with the predetermined time delay.

3. A fixing device according to claim 2, wherein said plurality of heater lamps comprise a first heater lamp, and a second heater lamp whose power consumption is larger than that of said first heater lamp; and wherein said control comprises:

a drive command generator for generating first and second pulsed drive commands of which cycles, pulse widths and rise timings are the same and which have first and second voltage levels, respectively;

a delay circuit providing said second drive command with a predetermined time delay thereby to generate a third drive command having the second voltage level;

a roller temperature detector for detecting temperatures on the surface of said fixing heat roller;

a bias supply circuit for supplying first and second bias voltages corresponding to the temperatures detected by said roller temperature detector;

a first comparator for comparing the first voltage level of said first drive command and said first bias voltage;

a first lamp drive for driving said first heater lamp if said first comparator determines that said first voltage level is higher than said first bias voltage;

a second comparator for comparing the second voltage level of said third drive command and said second bias voltage; and a second lamp drive for driving said second heater lamp if said second comparator determines that said second voltage level is higher than said second bias voltage.

4. An image forming apparatus comprising:

a photosensitive body on which a latent image is formed;

a developing device for visualizing the latent image on said photosensitive body;

a transfer device for transferring the visualized image to a paper sheet;

a fixing device for fixing the transferred image;

said fixing device comprising a pressure roller, a fixing heat roller having disposed therein a plurality of heater lamps and serving in conjunction with said pressure roller to press the paper sheet conveyed thereto for heat fixing a toner image formed on the paper sheet, and a control serving, in activating the heater lamps, to drive at least one of said heater lamps earlier than the other heater lamps and drive said other heater lamps with a predetermined time delay, wherein said at least one of said heater lamps has a power consumption that is smaller than that of the other heater lamps.

5. An image forming apparatus according to claim 4, wherein said control serves, in activating the heater lamps, to drive firstly said at least one heater lamp and to drive said other heater lamps with the predetermined time delay.

6. A method of heating a fixing heat roller which has disposed therein a plurality of heater lamps and serves to press a paper sheet conveyed between said fixing heat roller and a pressure roller for heat fixing a toner image formed on the paper sheet, the method comprising the steps of:

in activating the heater lamps, driving at least one of said heater lamps earlier than the other heater lamps; and driving said other heater lamps with a predetermined time delay, wherein said at least one of said heater lamps driven earlier than said other heater lamps has a power consumption which is smaller than that of said other heater lamps.

7. A fixing heat roller for a fixing device, which has disposed therein at least two heater lamps and serves to press a paper sheet conveyed between said fixing heat roller and a pressure roller for heat fixing a toner image formed on the paper sheet, wherein said at least two heater lamps includes:

a first heater lamp of which power consumption is smaller than that of the other heater lamps and which is firstly started to be driven in activating the fixing device; and a second heater lamp of which power consumption is larger than that of said first heater lamp and which is started to be driven after a predetermined length of time from the start of driving said first heater lamp.

* * * * *